United States Patent [19]

Mays

[11] Patent Number: 4,575,154

[45] Date of Patent: Mar. 11, 1986

[54] IN SITU LEACH METHOD

[76] Inventor: Wallace M. Mays, 4730 Sea Island, Corpus Christi, Tex. 78413

[21] Appl. No.: 562,932

[22] Filed: Dec. 19, 1983

[51] Int. Cl.[4] ..... E21B 43/28; E21B 43/40

[52] U.S. Cl. ..... 299/4; 299/5; 299/7; 166/79; 166/266; 423/7

[58] Field of Search ..... 299/4, 5, 7; 166/79, 166/266, 267, 278; 423/7, 17, 18, 20

[56] References Cited

U.S. PATENT DOCUMENTS

| | | | |
|---|---|---|---|
| 2,207,334 | 7/1940 | Reynolds | 166/278 |
| 2,444,629 | 7/1948 | Bromberg | 299/7 X |
| 2,932,552 | 4/1960 | Weiss et al. | 423/7 |
| 3,708,206 | 1/1973 | Hard et al. | 299/5 |
| 4,033,868 | 7/1977 | Meichsner et al. | 423/7 X |
| 4,054,320 | 10/1977 | Learmont | 299/4 |
| 4,103,963 | 8/1978 | Espenscheid et al. | 299/4 |
| 4,105,253 | 8/1978 | Showalter | 299/4 |
| 4,137,290 | 1/1979 | Degenkolb | 423/7 X |
| 4,296,075 | 10/1981 | Yan | 423/7 |
| 4,312,839 | 1/1982 | Habib, Jr. | 423/7 X |

*Primary Examiner*—George A. Suchfield
*Attorney, Agent, or Firm*—Drude Faulconer

[57] ABSTRACT

A method for the in situ leaching of a subterranean mineral (e.g. uranium) deposit which permits the use of downflow ion exchange columns without requiring expensive filtration equipment to remove particulate material and/or sediment from the leach solution. The injection and production wells are gravel packed so that all of the heavier particulate material will be filtered from the leach solution as it flows into the production well. The bed of ion exchange resin in the downflow column is then used to filter the finer sediment from the leach solution as the resin adsorbs the uranium from the leach solution. The barren leach solution from the ion exchange column can be used to makeup fresh leach solution without any further filtration. The loaded resin is removed from the ion exchange columns and is screened to remove the fine sediment. The resin is then eluted and screened again to remove any sediment that may accumulate during elution.

9 Claims, 2 Drawing Figures

24
22
20
21
23
25
26
27
29
28
13
16
11
10
17
14
15
12
15
14

30
36
42
31
33
37
35
34
41
25
33a
32
39
40

IN SITU LEACH METHOD

DESCRIPTION

1. Technical Field

The present invention relates to the in situ leaching of a mineral, e.g. uranium, from a subterranean deposit and more particularly relates to a method, especially adaptable for leaching a plurality of small, scattered uranium deposits with a minimum of equipment and manpower.

2. Background of the Invention

In a typical in situ leach operation, wells and completed into a mineral or metal value (e.g. uranium) bearing formation and an appropriate leach solution is flowed between injection and production wells. The uranium and/or related values are dissolved into the leach solution and are produced therewith to the surface. The leach solution is then processed to recover the uranium therefrom.

Probably the most common and best known techniques for recovering the uranium values from the leach solution after it is produced to the surface is to flow the leach solution throught an ion exchange column where the uranium is absorbed onto a bed of an ion exchange resin. The loading efficiencies of the resin bed are higher when the leach solution is flowed downward through the resin (i.e. downflow column) because of the better contact between the leach solution and the resin and the longer contact time therebetween. However, most leach solutions produced from subterranean deposits have a substantial amount of particulate material, e.g. sand and/or other sediment, entrained therein which tends to filter out as the leach solution flows downward through the resin bed. This accumulated particulate material tends to plug the resin bed thereby severally restricting flow therethrough. Operations have to be stopped and the resin bed backwashed or otherwise treated at frequent intervals before the resin can be adequately loaded. This obviously adversely affects the economics of the leach operation.

To alleviate this problem, expensive filteration devices must be installed upstream of the ion exchange column to remove the particulate material from the leach solution before it passes through the column. A typical filteration device used for this purpose is comprised of a vessel filled with gravel or the like. However since the filter vessel must be a pressure vessel, it costs substantially the same as the expensive vessel used for the ion exchange column and accordingly adds substantially to the overall costs of what is already a marginal commercial operation in many cases. Also, unfortunately, the particulate material as it is filtered from the leach solution has a tendency to plug the gravel bed of the filter column. This requires that operations be stopped at frequent intervals while the gravel bed is "backwashed" to unplug some. Obviously, this also adversely affects the economics of the leach operation.

To avoid the substantial expense of this filteration step, many in situ leach operations have switched to "upflow" ion exchange columns wherein the leach solution flows upward through the resin bed in the column. Less expensive filter means, e.g. hydrocyclone separators, are positioned upstream of the upflow columns to remove the larger grained, particulate material. Due to the nature of the dynamics of upflow, the fine particles are carried through the resin bed and out of the column with the now barren leach solution. Since in almost all leach operations of this type, this barren leach solution is used to makeup fresh leach solution for recycle, it must be further filtered after leaving the column to remove the fine sediment which might otherwise plug the injection well when the fresh leach solution is injected therethrough.

Further, although upflow columns can handle higher flowrates than downflow columns, the overall loading efficiencies of the ion exchange resin beds in upflow columns in adsorbing uranium at these higher flowrates are substantially less than those of the resin beds in downflow columns. This difference in loading efficiencies requires the use of a larger number of upflow columns, usually linked in series, to achieve the same actual recovery of uranium as that which can be achieved with fewer downflow columns. Accordingly, the larger number of columns required substantially adds to the cost of the equipment needed for a particular leach operation.

In leach operations as heretofore described, whether upflow or downflow columns are used, once the resin in the columns is sufficiency loaded, the resin is then eluted to recover the uranium therefrom. This elution step is typically carried out by (a) flowing an eluant through the resin bed, in place, or (b) transferring the loaded resin to a separate elution column. This separate elution column may be located on site or more likely is located at central location where is can service several leach operations being carried out to recover uranium for different deposits scattered through a common geographical area. This substantially reduces the amount of equipment and manpower required to produce the scattered deposits and may be the only way some deposits can be commercially exploited.

To summarize the above, fewer downflow columns are normally required than upflow columns for processing the leach solution from the same leach operation with the same efficiency. However, heretofore, substantially more expensive filtration equipment was required when downflow columns were used to commercially process the leach solution.

DISCLOSURE OF THE INVENTION

The present invention provides a method for the in situ leaching of a subterranean mineral (e.g. uranium) deposit which permits the use of downflow ion exchange columns without requiring the expensive filtration equipment previously required in operations of this type. The present invention is particularly adaptable for leaching several deposits scattered over a common geographical area in that it substantially reduces the equipment and manpower normally required for such operations.

More specifically, the present invention provides a method for in situ leaching wherein at least all of the production wells used in the leach operation are completed so that each is "gravel packed" adjacent the deposit to be leached. The gravel pack in the production wells serve as the primary filtering means to remove particulate material from the produced leach solution as it flows into the production wells. The relatively particulate-free leach solution is then pumped without further filtering to downflow ion exchange columns at the surface. Preferably the leach solution is flowed through a surge tank to steady out the flow, vent gas from the leach solution, and settle out some of any of the heavier sediment that may remain in the leach solution before it is flowed through the down flow columns.

As the leach solution flows downward through the resin bed in the column, the resin bed, itself, acts as a filter to remove any finer sediment that may remain in the leach solution. Accordingly, the gravel packs in the wells and the resin bed, itself, are the only filtering means required in the leach circuit of present invention. By using the resin bed to filter out the fine sediment from the leach solution, the barren leach solution flowing from the ion exchange column can be used to make up fresh leach solution without any further filtering thereof. This fresh leach solution can then be reinjected into the uranium deposit without plugging the injection wells since substantially all of the sediment has been removed from the leach solution.

Further, in accordance with the present invention, once the resin in the downflow ion exchange column is loaded with uranium, the loaded resin is removed from the column and transported to a central resin elution processing facility. The loaded resin is then screened and washed to remove any fine particulate material or sediment that has been filtered from the leach solution by the resin during the loading step. The resin is next placed in an elution column and eluted to recover the uranium values from the resin. After elution, the resin is removed from the elution column and is preferably screened and washed again to remove any sediment that may have collected during the elution step. The removal of this sediment by regularly screening the resin each time it is eluted keeps the sediment from accumulating in the resin bed which may otherwise eventually plug the resin bed during the loading step and/or the injection wells if carried out of the resin bed by the barren leach solution.

BRIEF DESCRIPTION OF THE DRAWINGS

The actual construction, operation, and apparent advantages of the present invention will be better understood by referring to the drawing in which like numerals identify like parts and in which.

BEST MODE FOR CARRYING OUT THE INVENTION

Figure 1:
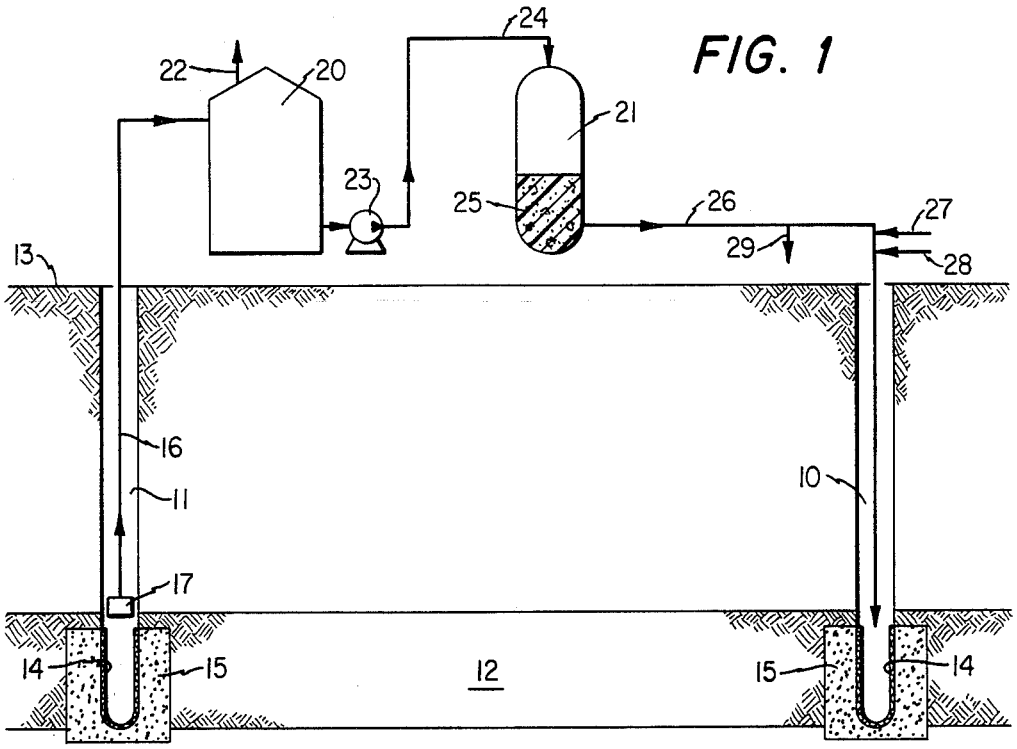
FIG. 1 is a schematical view of an in situ leach operation in accordance with the present invention.

Referring more particularly to the drawings, FIG. 1 discloses an in situ leach operation having an injection well 10 and one or more production wells 11 (only one shown in FIG. 1) spaced therefrom. All of the wells are completed into a subterranean, mineral bearing (e.g. uranium) deposit 12. As understood by those skilled in the art, in leach operations of this type, a leach solution (e.g. carbonated water, ammonium carbonate, hydrochloric acid, sulfuric acids, etc.) and an oxidant (e.g. oxygen) are flowed through the deposit from the injection wells to the production wells. As the leach solution flows through deposit 12, it dissolves the uranium values from the deposit and carries them to the surface 13 through the production wells 11. For a typical example of such operation, see U.S. Pat. No. 4,105,253.

In accordance with the present invention, all production wells 11 and preferably all of the injection wells 10 used in the leach operation are completed so that each well is "gravel packed" adjacent the deposit to be leached. Each well is preferably completed by first drilling, casing, and cementing the respective wellbore to a point just above deposit 12 (e.g. one foot above) and then continuing drilling through the cased borehole to thereby extend the wellbore downward through deposit 12. With this completion method, the deposit is never exposed to the cement during casing operations and accordingly the permeability of the deposit is not damaged by the cement. This, in turn, insures a much improved flow efficiency for each well after completion.

After the wellbore is drilled through the deposit 12, at least a portion thereof is underreamed and a perforated liner 14 (e.g. wellscreen) is positioned therein. Gravel 15 is then pumped around liner 15 to fill the underreamed cavity and the well is completed. As will be understood in the art, the openings in liner 14 and the size of the gravel particles 15 are selected in accordance with well known and established procedures which are based on the size of the particulate material to be filtered from the leach solution. A complete description of the preferred gravel pack well completion is fully disclosed in the present inventor's copending U.S. application Ser. No. 549,619, filed Nov. 7, 1983; and is incorporated in its entirely herein by reference.

After wells 10 and 11 are gravel pack completed, a leach solution is injected through well 10 and flows through deposit 12 to production well 11. Pregnant leach solution (i.e. leach solution containing dissolved uranium values) flows into well 11 through gravel 15 and liner 14 which filter out substantially all of any particulate material that may be in the pregnant leach solution. Although some fine sediment may remain in the pregnant leach solution after it flows through the gravel pack, substantially all of the larger-grained particulate material will be removed.

Downhole pump 17 pumps the filtered, pregnant leach solution to surface 13 through tubing 16. Preferably the leach solution flows through surge tank 20 which steadies out the flow rate in the leach circuit and allows the heavier particles of any remaining sediment to settle out of the leach solution. Also, tank 20 is vented at 22 to vent any gas that may have been produced with the pregnant leach solution which, in turn, substantially reduces the pressure drop normally experienced across the ion exchange columns.

Pump 23 transfers the leach solution from surge tank 20 to downflow ion-exchange column 21 through flowline 24. As understood in the art, downflow column 21 is a pressure vessel which is at least partially filled with a bed of a particulate, ion-exchange resin 25, e.g. quaternary amine resin, which is capable of absorbing the uranium values from the leach solution as it flows therethrough. The pregnant leach solution enters the top of column 21, preferably through an inlet having an impurgement baffle (not shown), flows downward through resin bed 25, and out the bottom of column 21, preferably after passing through screened collectors (not shown) positioned across the lower portion of column 21.

As the leach solution flows downward through resin bed 25, the resin absorbs the uranium values from the leach solution. At the same time, the resin bed 25 acts as a filter to remove any remaining fine sediment from the leach solution. The removed sediment is fine enough and in such small quantities so as not to cause any noticeable plugging problem under normal loading operations.

The stripped leach solution (i.e. barren leach solution) is now substantially free of all particulate material and sediment as it flows from column 21 through return line 26 and is used to makeup fresh leach solution without any further filtering. Fresh leach solution is madeup by injecting leach chemicals, (e.g. carbon dioxide, ammonia, oxygen, etc.) into the barren leach solution at points 27,28. The fresh leach solution is then injected into deposit 12 through injection well 10 to continue the leach operation. Since the fresh leach solution is effectively free of particulate material and sediment, the problem of plugging injection well 10 is alleviated. Return line 26 has a purge line 29 connected thereto to remove any excess barren leach solution from the leach circuit before fresh leach solution is made up. It can be seen from the above description that the leach circuit of the present invention reduces the amount of equipment required to a minimum since no tanks or pumps are needed other than those disclosed.

Figure 2:
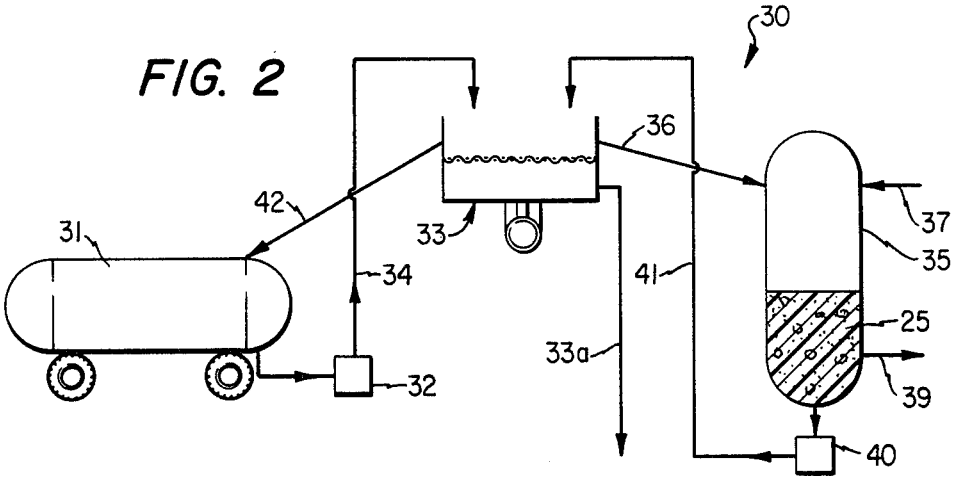
FIG. 2 is a schematic view of the elution processing facility of the present invention.

Once resin bed 25 is sufficiently loaded, the resin is removed from column 21 and transported to a central resin processing facility 30 (FIG. 2) where it is eluted to recover the uranium values from the resin. Facility 30 may be located in close proximity to column 21 or preferably is located at a site which can easily process the loaded resine from several different leaching operations which are being carried out to recovery uranium from deposits scattered throughout a common geographical area. This substantially reduces the capital investment and manpower required to produce such deposits and in most instances may be the difference between a commercially successful operation and one that is not.

As understood in the art, resin 25 is pumped or flowed by water pressure from column 21 through a resin outlet (not shown) to tank trailer 31 (FIG. 2) on the like, in which, resin 25 is then transported to facility 30. Resin 25 is then pumped from trailer 31 by pump 32 onto screening means 33 through line 34. Screening means 33 may be any of several different, commercially-available screening devices (e.g. Sweco Vibrating Screen, distributed by Sweco, Inc., Los Angeles, Calif.). The openings in screen of means 33 is sized to prevent the resin particles from passing therethrough while allowing any sediment (only fine sediment will be present) in the resin bed to pass therethrough. The resin 25 is vibrated and washed with water while on screening means 33 to aid in removing the undesirable sediment therefrom. The removed sediment and wash water is removed from means 33 through drain 33*a*.

After the sediment is washed and vibrated from the resin, the resin is transferred to elution column 35 through line 36 where it is eluted, as will be understood by those skilled in the art. A suitable eluant, e.g. ammonium carbonate or the like, is flowed into column 35 through inlet 37, down through the resin to desorb the uranium therefrom, and out outlet 38. The eluate is then further processed to recover the final uranium product.

After resin 25 is sufficiently eluted, the stripped resin is preferably pumped by pump 40 back onto screening means 33 through line 41 where it is again vibrated and washed to remove any sediment that may have accumulated during the elution step. The resin in then reloaded on trailer 31 through line 42 and is now ready for reuse in ion exchange column 21. The removal of the sediment by regularly screening the resin before each time it is eluted keeps sediment from accumulating in the resin bed which might eventually plug the resin bed and/or the injection well 11. The screening of the resin after it is eluted is to move any calcium carbonate or undissolved soda ash particles that may have collected in the resin bed during the elution step.

It can be seen from the above that by gravel packing the injection and production wells to remove the larger particulate material from the leach solution as it is produced therethrough and then utilizing the resin bed in the downflow ion exchange to filter the fine sediment from the leach solution, the present invention provides a leach operation wherein downflow columns can be used without the need for expensive external filtration devices. Further, by screening the resin before and after elution, accumulation of sediment in the leach circuit is eliminated thereby alleviating the plugging problems normally encountered in operations of this type. Still further, the present invention requires a minimum of equipment and manpower in the situ leaching of several different mineral deposits which may be scattered on a common geographical area and which may be uneconomical to exploit with presently known methods.

What is claimed is:

1. A method for the in situ leaching of uranium and/or related valves from a subterranean deposit, said method comprising:

drilling at least one injection well and at least one production well into said deposit at spaced intervals from each other;

completing said at least one production well so that said production well has a gravel pack therein lying adjacent said deposit;

injecting a leach solution into said deposit through said injection well and flowing said leach solution through said deposit to dissolve uranium and/or related valves therein;

filtering said leach solution and said uranium and/or related valves dissolved therein through said gravel pack as said leach solution and dissolve uranium and/or related valves flows into said production well to remove substantially all of any particular material and/or sediment entrained in said leach solution;

flowing said leach solution and dissolved uranium and/or related valves from said production well and downward through a bed of an ion exchange resin without additional filtering of particulate material from said leach solution;

absorbing said uranium and/or related valves from said leach solution on said bed of ion exchange resin as said leach solution flows downward therethrough;

filtering substantially all of any remaining particulate material and/or sediment from said leach solution into said bed of ion exchange resin as said leach solution flows downward therethrough; and adding leach chemicals to said leach solution after said leach solution has flowed through said bed of ion exchange resin without any further filtering of particulate material and/or sediment from said leach solution to thereby makeup fresh leach solution for recycle in the leaching operation.

2. The method of claim 1 including:

separating any gas from said leach solution before said leach solution is flowed downward through said bed of ion exchange resin.

3. The method of claim 2 wherein said gas is separated from said leach solution by flowing said leach solution from said production through a surge tank and venting gas from said surge tank.

4. The method of claim 1 including:

completing said at least one injection well so that said injection well has a gravel pack therein lying adjacent said deposit.

5. The method of claim 1 wherein said bed of ion exchange resin is positioned within a downflow ion exchange column vessel.

6. The method of claim 5 including:

removing said bed of ion exchange from said vessel when said bed of exchange resin becomes loaded with uranium and/or related valves;

removing said particulate material and/or sediment from said bed of ion exchange resin that was accumulated therein from said leach solution; and eluting said bed of ion exchange to recover said uranium and/or valves therefrom.

7. The method of claim 6 including:

removing any particulate material and/or sediment from said bed of ion exchange resin that may accumulate in said bed of ion exchange resin during the elution thereof after said resin has been eluted.

8. The method of claim 7 wherein the steps of removing said particulate material and/or sediment from said bed of ion exchange resin before and after elution comprises:

screening said bed of ion exchange resin.

9. The method of claim 8 including:

washing said bed of ion exchange resin while screening said bed of ion exchange resin.

* * * * *